US006642814B2

(12) United States Patent
Lamont et al.

(10) Patent No.: US 6,642,814 B2
(45) Date of Patent: Nov. 4, 2003

(54) SYSTEM FOR CROSS COUPLING RESONATORS

(75) Inventors: Greg Lamont, Jackson, NJ (US); Jeff Blair, Freehold, NJ (US)

(73) Assignee: Alcatel, Radio Frequency Systems, Inc., Meriden, CT (US)

( * ) Notice: Subject to any disclaimer, the term of this patent is extended or adjusted under 35 U.S.C. 154(b) by 0 days.

(21) Appl. No.: 10/015,699

(22) Filed: Dec. 17, 2001

(65) Prior Publication Data

US 2003/0112099 A1 Jun. 19, 2003

(51) Int. Cl.[7] ..... H01P 1/201
(52) U.S. Cl. ..... 333/202; 333/203
(58) Field of Search ..... 333/202, 203, 333/206, 208, 212, 230

(56) References Cited

U.S. PATENT DOCUMENTS

| | | | | |
|---|---|---|---|---|
| 3,273,083 A | | 9/1966 | Rose | |
| 3,327,255 A | | 6/1967 | Bolljahn et al. | |
| 4,186,359 A | | 1/1980 | Kaegebein | |
| 4,249,147 A | | 2/1981 | Kaegebein | |
| 4,464,640 A | | 8/1984 | Nishikawa et al. | |
| 4,477,785 A | * | 10/1984 | Atia | 333/202 |
| 4,740,765 A | * | 4/1988 | Ishikawa et al. | 333/202 |
| 4,890,078 A | | 12/1989 | Radcliffe | |
| 5,051,714 A | | 9/1991 | Bentivenga et al. | |
| 5,153,541 A | | 10/1992 | Johnson et al. | |
| 5,262,742 A | | 11/1993 | Bentivenga | |
| 5,446,729 A | | 8/1995 | Jachowski | |
| 5,684,438 A | * | 11/1997 | D'Oro et al. | 333/202 |
| 5,714,919 A | | 2/1998 | Satoh et al. | |
| 5,748,058 A | | 5/1998 | Scott | |
| 5,777,534 A | | 7/1998 | Harrison | |
| 5,898,349 A | * | 4/1999 | Hattori et al. | 333/134 |
| 5,905,416 A | * | 5/1999 | Schmid et al. | 333/134 |
| 6,002,311 A | * | 12/1999 | Wey et al. | 333/219.1 |
| 6,078,231 A | * | 6/2000 | Pelkonen | 333/134 |
| 6,081,175 A | | 6/2000 | Duong et al. | |
| 6,084,487 A | | 7/2000 | Hoffman | |
| 6,208,221 B1 | * | 3/2001 | Pelz et al. | 333/126 |
| 6,222,429 B1 | | 4/2001 | Satoh et al. | |
| 6,329,889 B1 | * | 12/2001 | Puoskari | 333/202 |

FOREIGN PATENT DOCUMENTS

| | | | |
|---|---|---|---|
| EP | 0069651 A1 | * | 1/1983 |
| FR | 2509535 | * | 1/1983 |
| JP | 53072549 A | * | 6/1978 |

* cited by examiner

*Primary Examiner*—Seungsook Ham
(74) *Attorney, Agent, or Firm*—Sughrue Mion, PLLC

(57) ABSTRACT

A system for inductively cross coupling resonators. Two resonators are interconnected by a cross coupler with the two ends, each end having a hole. The holes secures each end of the cross coupler to one of the resonators. The use of a stamped piece as a cross coupler results in a repeatable placement between resonators that minimizes any variation in coupling between resonators due to human error during assembly. This repeatability reduces assembly time and assembly cost.

17 Claims, 4 Drawing Sheets

SYSTEM FOR CROSS COUPLING RESONATORS

FIELD OF THE INVENTION

The present invention generally relates to an improved system for cross coupling resonators.

BACKGROUND OF THE INVENTION

Cavity resonator filter assemblies are found in the receive and transmit sections of a diplexer used in a communication system. A plurality of resonators are located within the filter assembly. Such an assembly has a housing including walls that form the sides of the assembly and other walls that separate some of a plurality of resonators from each other. A top plate is attached to the top of the walls so that the assembly forms a cavity.

Each resonator of the assembly represents a pole of the filter response. The filter allows electronic signals of certain frequencies, the bandpass, to pass through the filter, while blocking or attenuating electronic signals of other frequencies, the stopband. Fine tuning of the assembly is provided by turning screws that extend through the top plate at locations above the resonators. This changes the distance that the screws extend through the plate, and thus their distance from the resonators.

Major tuning of the range of stopband frequencies of the resonator filter assembly is accomplished by changing the coupling between the resonators or by changing the number of resonators. Resonators that are closer to each other have a higher coupling value than resonators that are farther apart. Furthermore, the walls between the resonators, which were discussed above, decrease the coupling between resonators.

The stopband of the filter assembly can be increased by either increasing the number of resonators or by cross coupling a first resonator to a non-adjacent resonator, i.e. a resonator that would not be the next resonator with respect to the natural path of current from the first resonator. However, when space is limited within a cavity resonator filter assembly, cross coupling the resonators is the only option.

U.S. Pat. No. 6,208,221 teaches the use of wire loops to inductively cross couple non-adjacent resonators. The loops are attached and electrically connected to a pair of spaced elevated areas of the diplexer that are adjacent to the resonators. A wire soldered directly to each of two resonators can also be used to cross couple resonators.

Human error during the assembly of the wire to the resonators can cause variations in the placement of the wire with respect to the resonators, variations in the locations where the wire loop is soldered to the resonators, and variations in the formations of the loop. These variations affect the amount of cross coupling, which causes variations in the stopband attenuations. Therefore, what is needed is a cross coupler that provides a consistent and repeatable cross-coupling value between resonators.

SUMMARY OF THE INVENTION

This invention is directed to a novel system for inductively cross coupling resonators. Two resonators are interconnected by a cross coupler with a hole at each end. The holes secures each end of the cross coupler to one of the resonators.

The use of a stamped piece as a cross coupler results in a repeatable placement between resonators that minimizes any variation in coupling between resonators due to human error during assembly. This repeatability reduces assembly time and assembly cost.

BRIEF DESCRIPTION OF THE DRAWINGS

The advantages, nature and various additional features of the invention will appear more fully upon consideration of the illustrative embodiment of the invention which is schematically set forth in the drawings, in which.

DETAILED DESCRIPTION OF THE INVENTION

The preferred embodiment of the invention will be explained in further detail by making reference to the accompanying drawings, which do not limit the scope of the invention in any way. The invention relates to a novel means for cross coupling resonators within a cavity resonator assembly.

Figure 1:
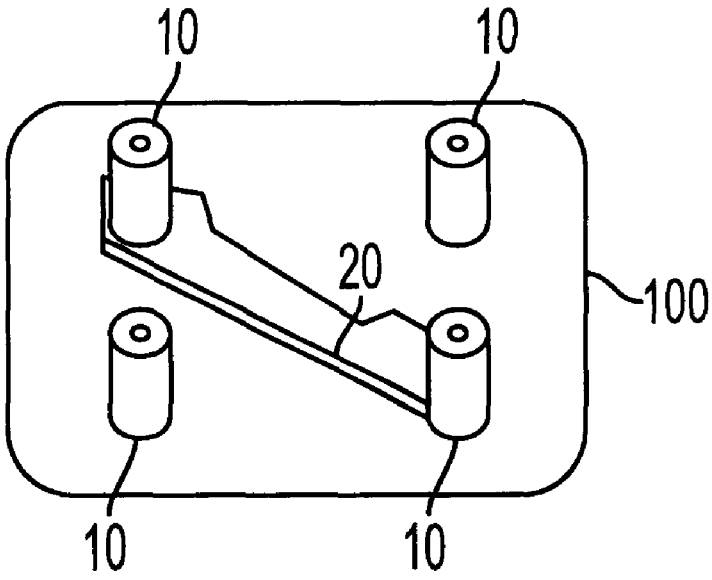
FIG. 1 is a three dimensional view of a resonator filter assembly with four resonators, in which two resonators are cross-coupled.
Figure 2:
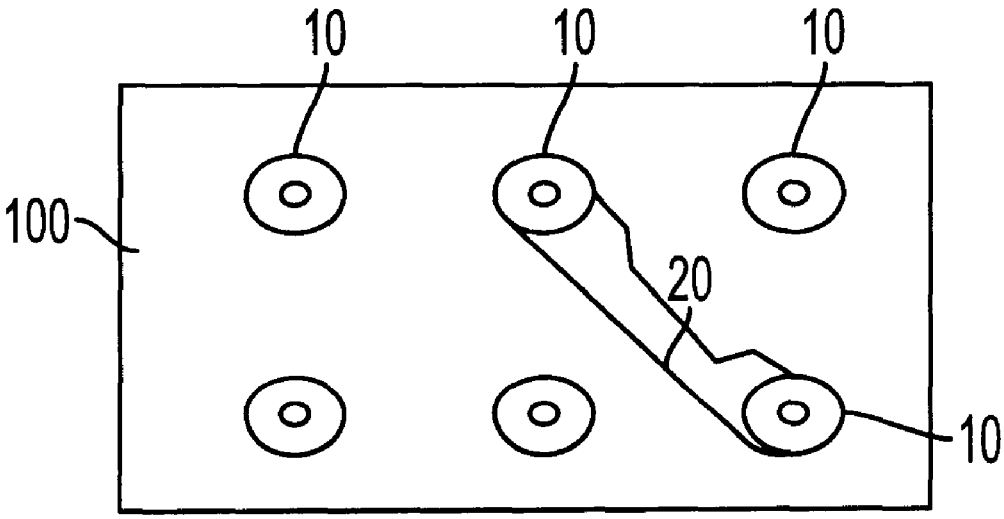
FIG. 2 is a top view of a resonator filter assembly with six resonators, in which two resonators are cross-coupled.

Referring to FIGS. 1 and 2, a resonator filter assembly 100 has a plurality of resonators 10, which are secured to a housing 100, as is discussed below. In a preferred embodiment, the housing 100 is made of aluminum, but the invention is not limited in this respect. Other conductive materials may be used for the housing 100 and resonators 10.

Figure 3:
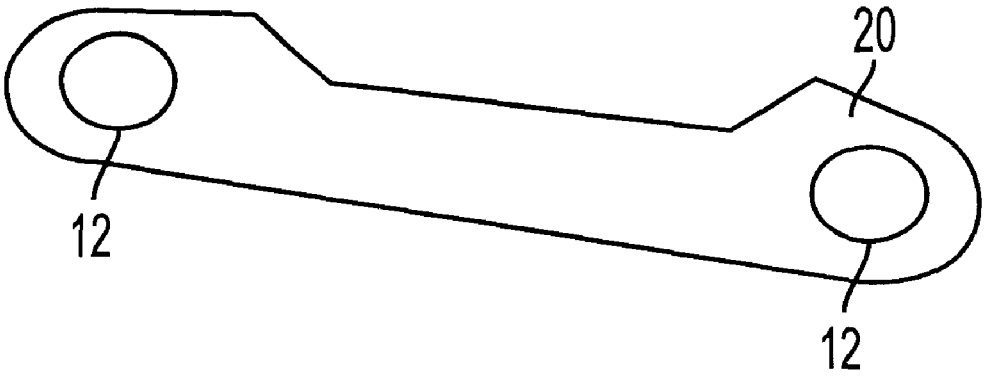
FIG. 3 a top view of the cross coupler of the present invention.

A cross coupler 20 interconnects two resonators 10. The cross coupler 20 is made of a conductive material, such as copper or aluminum. Turning to FIG. 3, in a first embodiment, the cross coupler 20 is formed by a stamping process and has two ends. Each end of the cross coupler 20 has an end hole 12.

Figure 4:
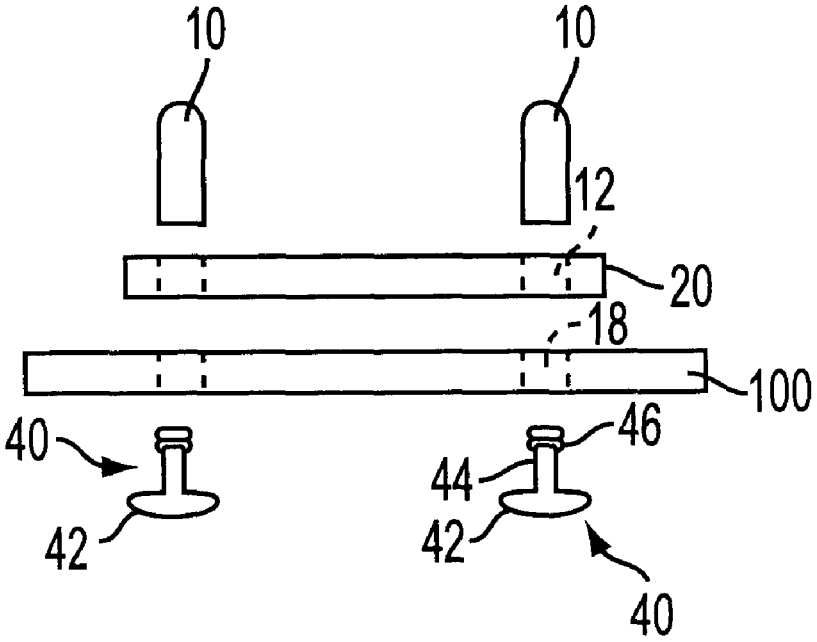
FIG. 4 is a side view showing the assembly of the cross coupler to the resonators.

Referring to FIG. 4, in this embodiment, through holes 18 extend through the housing 100 at the positions where each resonator 10 will be attached to the housing 100. To connect a cross coupler 20 between two resonators 10, each of the two holes 12 of the cross coupler 20 are placed over the two through holes 18. Two screws 40 are positioned so that they extend through the through hole 18 in the housing 100 and the end holes 12. The screw tops 42 are positioned at the underside of the housing 100 and hold each screw 40 into place. The extension portion 44 of each screw extends through a through hole 18 and an end hole 12. The ends 46 of the extension portions 44 of the two screws 40 are threaded. Each resonator 10 has a threaded hole. Screwing the threaded resonator 10 onto the threaded end 46 of extension portions 44 of the screw 40 places the cross coupler 20 in a position between the resonators 10 and the housing 100.

In an alternative embodiment, a cross coupler that is similar to the cross coupler 20 discussed with respect to FIG. 4 is formed into the housing 100. The resonators 10 are screwed to the housing 100 in the manner described above.

Figure 5:
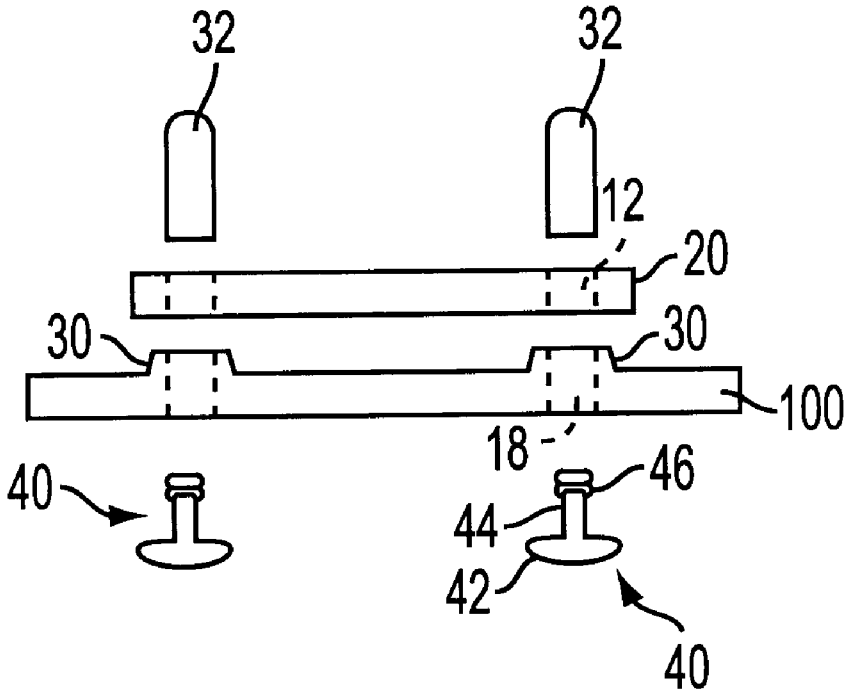
FIG. 5 is a side view showing the assembly of the cross coupler to the resonators for the embodiment in which the cross coupler is located between top portions and bottom portions of the resonators.

Referring to FIG. 5, in another embodiment in which the cross coupler 20 is displaced from the housing 100, for each resonator 10, the housing 100 has a boss portion 30 that extends above the bottom of the housing 100. The boss portions 30 are the bottom parts of what will be fully assembled resonators 10. Through holes 18 extend through both the housing 100 and boss portion 30.

To connect a cross coupler 20 between two resonators 10, each of the two end holes 12 are placed over two boss portions 30. Two screws 40 are positioned so that they extend through the through holes 18 in the housing 100 and the end holes 12. Screw tops 42, which are placed at the underside of the housing 100, are designed to hold the screw into place. The extension portion 44 of each screw 40 extends through a through hole 18 and an end hole 12. The ends 46 of the extension portions 44 of the two screws 40 are threaded.

Figure 6:
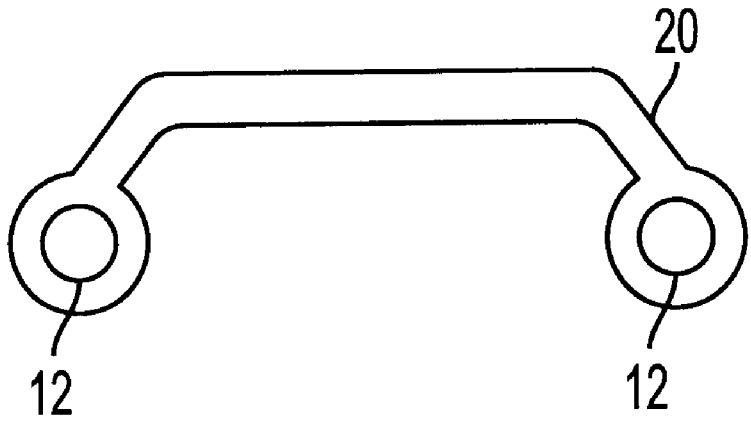
FIG. 6 is a top view of a cross coupler that is bent horizontally.
Figure 7:
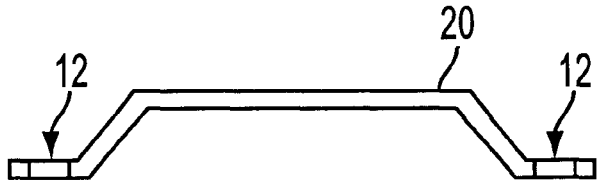
FIG. 7 is a top view of a cross coupler that is bent vertically.

The inside of the top portion 32 of each resonator 10 has a threaded hole. Screwing the threaded resonator top part 32 onto the threaded end 46 of extension portions 44 of the screw 40 places the cross coupler in a position between the resonator top part 32 and the boss portion With respect to any of the discussed embodiments, the amount of coupling between resonators 10 is changed by altering the length or the width of the cross coupler 20, or by changing the bend in the cross coupler 20. FIG. 6 shows a cross coupler 20 that is bent horizontally, and FIG. 7 shows a cross coupler 20 that is bent vertically.

Figure 8:
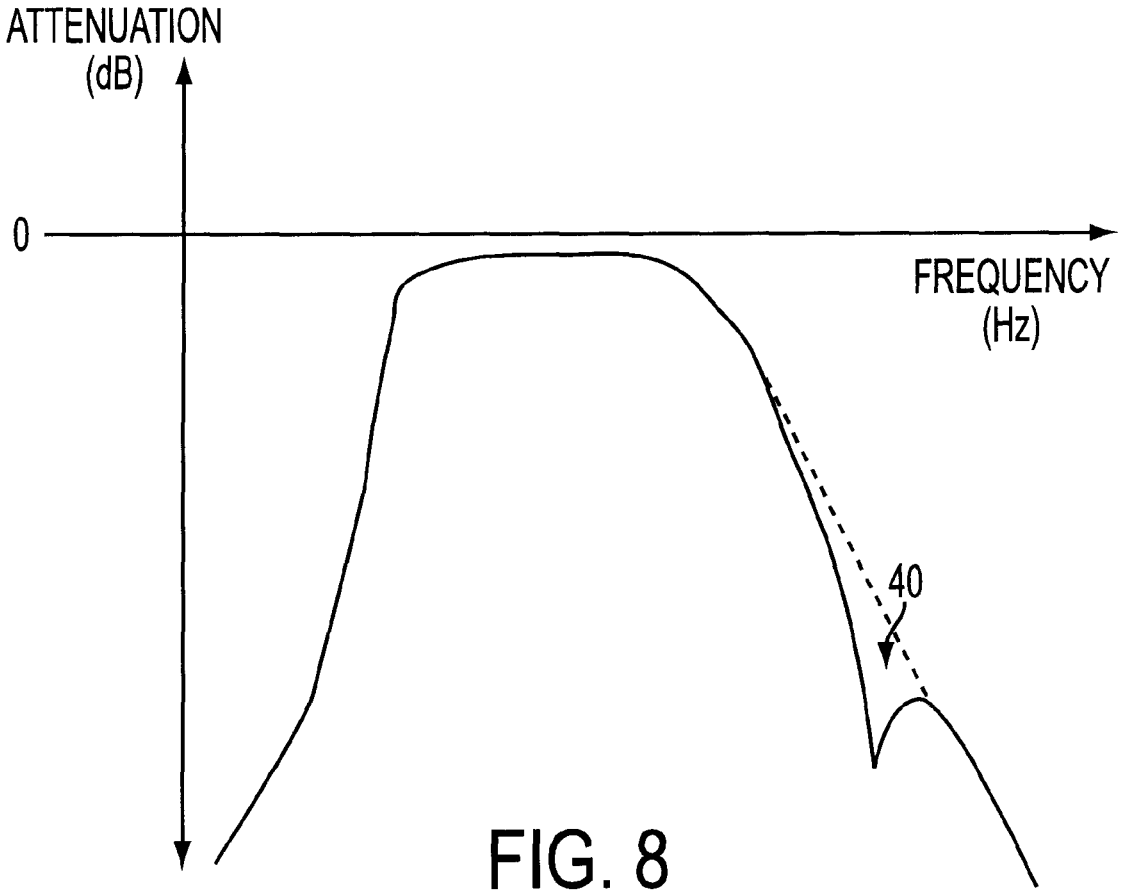
FIG. 8 is a graph showing a typical filter passband with an attenuation notch created by cross coupling.

Turning to FIG. 8, a graph shows attenuation versus frequency for an assembly in which non-adjacent resonators are cross-coupled. Cross coupling non-adjacent resonators provides a notch 40 of significant attenuation of the signal formed in the upper stopband. Although the improved system of cross coupling effectively changes the coupling value between non-adjacent resonators as shown, the system also can be used to increase the coupling between adjacent resonators. Multiple cross-couplers 20 of this type can be used with the filter assembly.

This improved system of cross coupling has produced repeatable results in filter assemblies with a center frequency from 800 MHz to 3 GHz with passbands ranging from a few kHz to a few hundred MHz.

It is of course understood that departures can be made from the preferred embodiment of the invention by those of ordinary skill in the art without departing from the spirit and scope of the invention that is limited only by the following claims, such as using the cross couplers with resonators of varying frequency passbands.

What is claimed is:

1. A cavity resonator filter assembly, comprising:

a housing including a base plate;

a plurality of resonators provided on the base plate; and at least one cross coupler interconnecting two of the plurality of resonators, the cross coupler having two ends, wherein one end of the cross coupler contacts one of the two resonators and the other end contacts the other of the two resonators, wherein each end of the cross coupler is positioned between one of the two of the plurality of resonators and the base plate, and wherein the two resonators are mounted on the cross coupler.

2. The cavity resonator filter assembly of claim 1, wherein the cross coupler is bent.

3. The cavity resonator filter assembly of claim 1, wherein the two resonators are non-adjacent.

4. The cavity resonator filter assembly of claim 1, wherein the cross couplers are formed into the housing.

5. The cavity resonator filter assembly of claim 1, wherein the cross coupler provides inductive cross coupling.

6. A cavity resonator filter assembly, comprising:

a housing including a base plate;

a plurality of resonators provided on the base plate; and at least one cross coupler interconnecting two of the plurality of resonators, the cross coupler having two ends wherein one end of the cross coupler contacts one of the two resonators and the other end contacts the other of the two resonators, wherein each end of the cross coupler is positioned between one of the two of the plurality of resonators and the base plate, further comprising two screws, wherein each of the ends of the cross coupler includes a hole, and wherein each of the screws extends through one of the holes and secures one of the ends of the cross coupler to one of the two resonators.

7. The cavity resonator filter assembly of claim 1, wherein the housing includes boss portions and the resonators include separate top portions, wherein each end of the cross coupler is positioned between one of the boss portions and one of the top portions.

8. The cavity resonator filter assembly of claim 7, wherein the cross coupler is bent.

9. The cavity resonator filter assembly of claim 7, wherein the two resonators are non-adjacent.

10. The cavity resonator filter assembly of claim 7, wherein the cross coupler provides inductive cross coupling.

11. A cavity resonator filter assembly, comprising:

a housing including a base plate;

a plurality of resonators provided on the base plate; and at least one cross coupler interconnecting two of the plurality of resonators, the cross coupler having two ends, wherein one end of the cross coupler contacts one of the two resonators and the other end contacts the other of the two resonators, wherein each end of the cross coupler is positioned between one of the two of the plurality of resonators and the base plate, wherein the housing includes boss portions and the resonators include separate top portions, wherein each end of the cross coupler is positioned between one of the boss portions and one of the top portions; and further comprising two screws, wherein each of the ends of the cross coupler includes a hole, and wherein each of the screws extends through one of the holes and secures one of the ends of the cross coupler to one of the two resonators.

12. The cavity resonator filter of claim 1, wherein the cross coupler is a stamped piece.

13. The cavity resonator filter of claim 3, wherein the cross coupler is a stamped piece.

14. The cavity resonator filter of claim 6, wherein the cross coupler is a stamped piece.

15. The cavity resonator filter of claim 7, wherein the cross coupler is a stamped piece.

16. The cavity resonator filter of claim 9, wherein the cross coupler is a stamped piece.

17. The cavity resonator filter of claim 11, wherein the cross coupler is a stamped piece.

* * * * *